US007347638B1

(12) United States Patent
Lin

(10) Patent No.: US 7,347,638 B1
(45) Date of Patent: Mar. 25, 2008

(54) PEN WITH A STORAGE FUNCTION

(76) Inventor: Hsiao-Chi Lin, 7F., No. 423, Mingshuei Rd., Jhongshan District, Taipei City 104 (TW)

( * ) Notice: Subject to any disclaimer, the term of this patent is extended or adjusted under 35 U.S.C. 154(b) by 0 days.

(21) Appl. No.: 11/655,277

(22) Filed: Jan. 19, 2007

(30) Foreign Application Priority Data

Nov. 24, 2006 (TW) ..... 95220780 U

(51) Int. Cl.
*B43K 29/00* (2006.01)
*B43K 7/06* (2006.01)
*B43K 29/10* (2006.01)
*G08B 23/00* (2006.01)

(52) U.S. Cl. ..... 401/195; 401/192; 362/118; 340/321

(58) Field of Classification Search ..... 401/195, 401/52, 192; 362/118; 340/321, 815.4, 340/815.53
See application file for complete search history.

(56) References Cited

U.S. PATENT DOCUMENTS 6,773,192 B1 * 8/2004 Chao ..... 401/195
6,932,276 B1 * 8/2005 Liu ..... 235/486
6,943,670 B2 * 9/2005 Liguori et al. ..... 340/321
7,029,193 B1 * 4/2006 Chao ..... 401/195

* cited by examiner

*Primary Examiner*—David J. Walczak
(74) *Attorney, Agent, or Firm*—Troxell Law Office, PLLC

(57) ABSTRACT

A pen with a storage function includes a penholder, an end of which is installed with a storage device, enabling a USB (Universal Serial Bus) connector of the storage device to be protruded out of the penholder, for connecting with an external computer to download data. A chosen place on a surface of the penholder is installed with a light pervious casing, and an inner wall of the penholder, corresponding to the light pervious casing, is surrounded with at least one solar power flashing LCD (Liquid Crystal Display), such that when the LCD has absorbed sufficient solar energy, commercial prints on the LCD can be flashingly displayed.

8 Claims, 4 Drawing Sheets

PEN WITH A STORAGE FUNCTION

BACKGROUND OF THE INVENTION (a) Field of the Invention

The present invention relates to a pen with a storage function, and more particularly to a pen which is provided with a USB (Universal Serial Bus) flash disk and a solar power flashing LCD (Liquid Crystal Display), such that the pen can freely store digital data and can flash to display prints at any time.

(b) Description of the Prior Art

If a computer user in old days needs to carry and transfer data to the other computer for work, the data is usually stored on a diskette or a CD (Compact Disc), and is then put into the other computer for accessing. However, as a development of the computer technology, a kind of USB (Universal Serial Bus) flash disk has shown up in the market to replace the aforementioned storage method. As the USB flash disk uses a plug-and-play USB interface, it is provided with a lot of memory space, and in the mean time, its access speed is also a lot quicker than the old floppy disk drive. Therefore, the user only needs to plug a USB connector of the USB flash disk into a USB socket of the computer to access and store the data.

However, the conventional USB flash disk is only provided with a single function of storing the data, and is also provided with a small size. Therefore, if the USB flash disk is not used, another place should be found to carefully keep it; otherwise, personal data is easy to leak out, which results in a severe outcome. On the other hand, as a book desk, an office desk, or a carry bag also contains pens and other stationery, it will be messy and is not easy to arrange if the USB flash disk is added in, which results in an unnecessary lost easily. Accordingly, how to design and develop a kind of ordinary pen which combines the USB flash disk and is added with a function of flashingly displaying commercial prints to prompt the user, decrease a chance of losing the data, facilitate the arrangement of the stationery, and increase the function of that pen, is an issue which needs to be resolved by related vendors.

SUMMARY OF THE INVENTION

The primary object of present invention is to provide a pen with a storage function, wherein a USB flash disk is combined on that pen, such that the pen can freely store digital data.

Accordingly, an end surface of a penholder of the pen of present invention is concaved with a hollow holding space for emplacing a storage device. An end of the storage device is a circuit board, and the other end is a USB (Universal Serial Bus) connector which is electrically connected with the circuit board, wherein the circuit board is located in the holding space of the penholder, and the USB connector is protruded out of the penholder for connecting with an external computer. The USB connector is sheathed with a protective outer cap which can be assembled with and separated from the penholder, to cover and hide this USB connector. While in using the storage device, the outer cap is opened, the USB connector is plugged into a USB socket of a computer for storing data, and the stored data is downloaded, so as to store the digital data in the pen. Accordingly, in carrying this pen, the data stored in that pen is also carried, thereby decreasing a chance of losing the data.

Another object of the present invention is to provide a pen with a storage function, wherein a surface of the pen is provided with a solar power flashing LCD (Liquid Crystal Display), to flashingly display commercial prints.

Accordingly, a chosen place on a surface of a penholder of the pen of present invention is provided with a light pervious casing, and an inner wall of the penholder, corresponding to the light pervious casing, is surrounded with at least one solar power flashing LCD, enabling the LCD to be installed on that inner wall. In addition, a surface of the LCD is also provided with the commercial prints, such that when the LCD has absorbed sufficient solar energy, the commercial prints can be flashingly displayed through the light pervious casing, to catch eyesight and show a location of that pen, thereby decreasing a chance of losing the pen.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
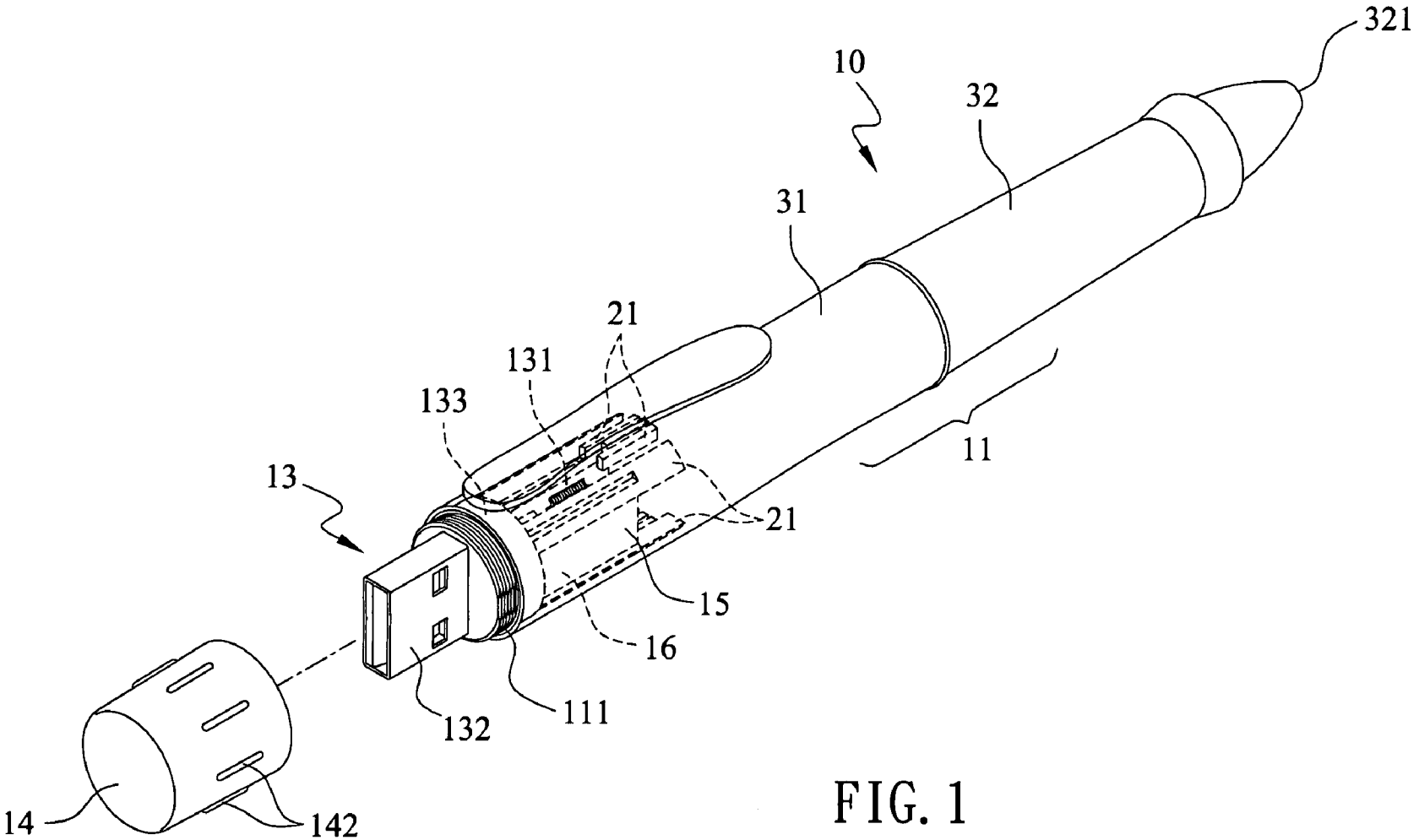
FIG. 1 shows a perspective view of a pen of the present invention.
Figure 2:
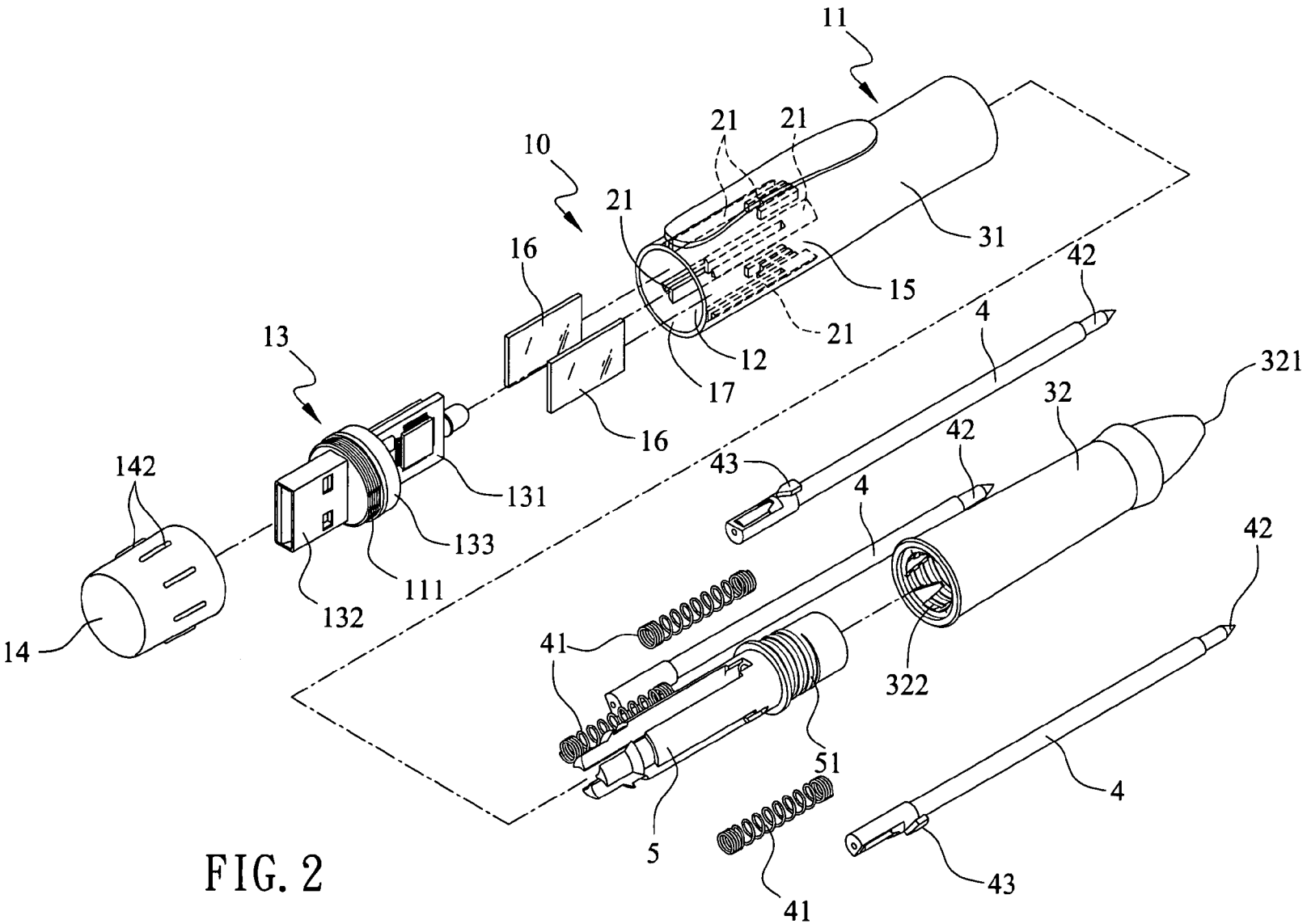
FIG. 2 shows an exploded view of a pen of the present invention.
Figure 4:
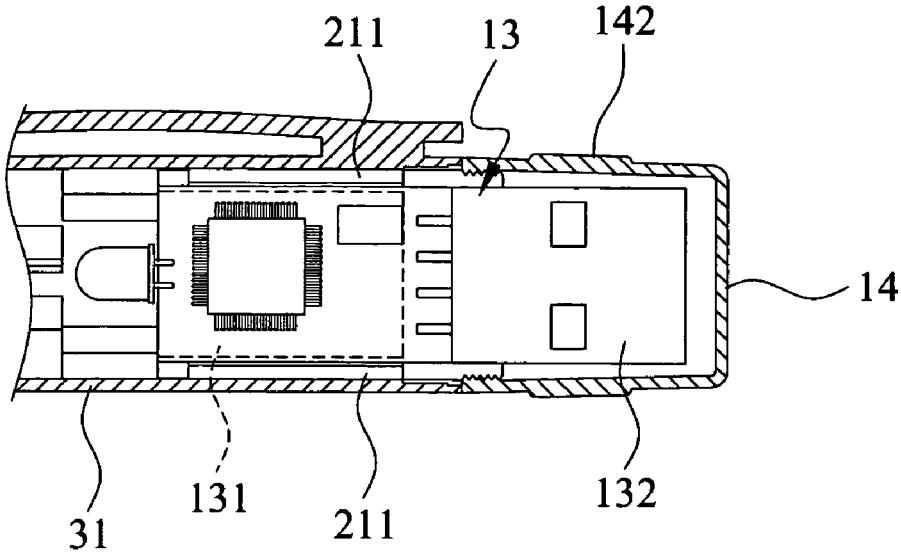
FIG. 4 shows a local exploded view of a pen of the present invention.

Referring to FIGS. 1, 2 and 4, a pen 10 (such as a fountain pen, a brush pen, a mechanical pencil, a multi-color pen, a ball-point pen, a watercolor pen, or a colored pen) of the present invention is provided with a body, and an end surface of a penholder 11 of the body is concaved with a hollow holding space 12 which is installed with a storage device 13. An end of the storage device 13 is a circuit board 131, and the other end is a USB (Universal Serial Bus) connector 132 (such as a male USB connector (plug)) which is electrically connected with the circuit board 131, wherein the circuit board 131 is located in the holding space 12 of the penholder 11, and the USB connector 132 is protruded out of the penholder 11 for connecting with an external computer. The USB connector 132 is also sheathed with a protective outer cap 14 which can be assembled with and separated from the penholder 11, to cover and hide this USB connector 132.

In addition, a chosen place on a surface of the penholder 11 of the pen 10 is provided with a light pervious casing 15 (such as a transparent casing), and an inner wall of the penholder 11, corresponding to that light pervious casing 15, is surrounded with at least one solar power flashing LCD (Liquid Crystal Display) 16, enabling the LCD 16 to be installed on the inner wall. A surface of the LCD 16 is also provided with commercial prints (such as logos, photographs and names, or pictures), and when the LCD 16 has absorbed sufficient solar energy, the commercial prints can be flashingly displayed through the light pervious casing 15.

Accordingly, in using the storage device 13, the outer cap 14 is opened, and the USB connector 132 is plugged into a USB socket of a computer for storing data, to proceed with a download of the stored data, such that the digital data can be stored in the pen 10. Accordingly, upon carrying the pen 10, the data stored in the pen 10 is also carried along with it. In the mean time, when each LCD 16 is flashingly displaying the commercial prints, user's eyesight can be caught to increase commercial benefits, and a location of the pen 10 can be displayed to decrease a chance of losing the pen 10.

Figure 3:
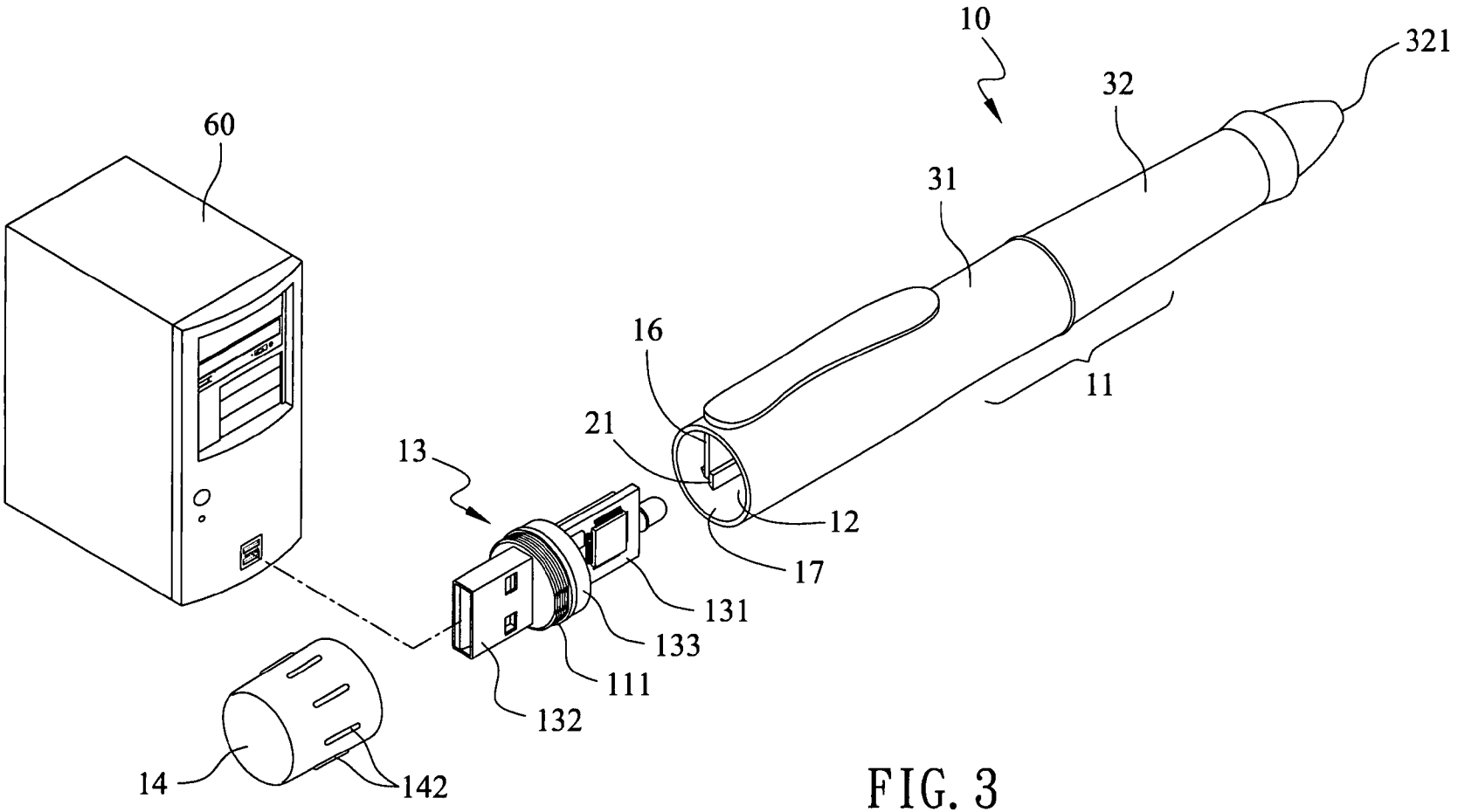
FIG. 3 shows a schematic view of a condition of using a pen of the present invention.
Figure 5:
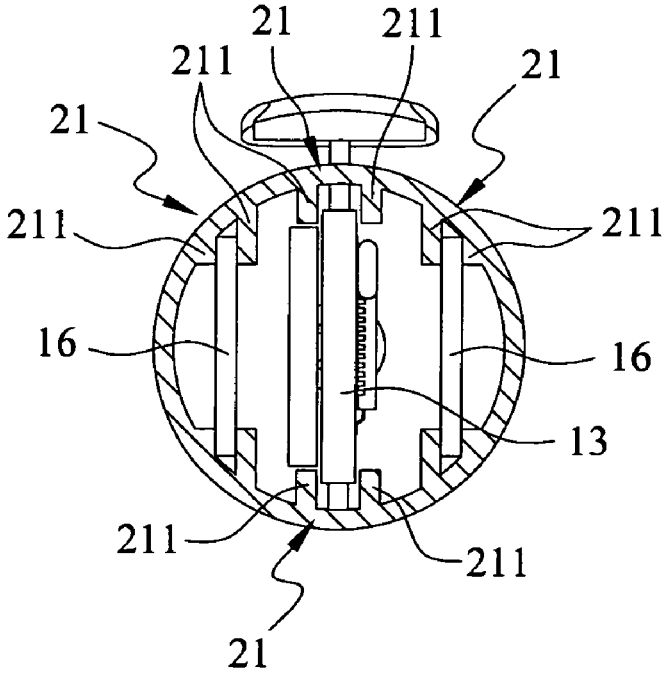
FIG. 5 shows a cutaway view of a pen of the present invention.

Referring to FIGS. 2, 3, and 5, in an embodiment of the present invention, an interior of the penholder 11 is installed with the storage device 13, and an upper and lower inner walls of the penholder 11 are provided respectively with an installation chute 21, with each of the installation chutes 21 being formed with a left and right clipping pieces 211 in a long-strip shape, for holding two side edges of the storage device 13 and the LCD 16, such that the storage device 13 and the LCD 16 can be inserted into the upper and lower installation chutes 21 from an opening 17 at an end of the penholder 11, and thus are clipped by the left and right clipping pieces 211 to be positioned on the upper and lower installation chutes 21, thereby being fixed in the penholder 11. When the storage device 13 or the LCD 16 needs to be replaced, the original storage device 13 or the LCD 16 can be directly taken out, and the other storage device 13 or LCD 16 is installed in the upper and lower installation chutes 21, thereby being installed in the penholder 11.

Moreover, a center location of the storage device 13 is provided with a round plug 133 having an outer diameter a little smaller than an inner diameter of the holding space 12 of the penholder 11, such that when the storage device 13 is installed in the upper and lower installation chutes 21, the round plug 133 can be exactly locked at an inner wall of the penholder 11, which enables the storage device 13 to be firmly fixed on the opening 17 at the end of the penholder 11. Even when the USB connector 132 is plugged into a USB socket of a computer, the storage device 13 is still not easy to be released from the penholder 11 by pulling force. Furthermore, referring to FIG. 3, the storage device 13 of the present invention can be also taken out of the penholder 11 to be directly connected with a computer 60.

Referring to FIGS. 2, 3, and 5 again, in an embodiment of the present invention, the outer cap 14 is screwed on the opening 17 at the end of the penholder 11, wherein an inner wall at a connection place of the outer cap is provided with a female thread (not shown in the drawings), and an end surface of the round plug 133, corresponding to that female thread, is provided with a male thread 111 which is fitted with the female thread, such that the outer cap 14 can be screwed on the opening 17 to cover and hide the USB connector 132 by screwing the female thread with the male thread 111. In addition, an outer surface of the outer cap 14 is surrounded with a plurality of projected ridges 142, such that when the outer cap 14 is turned open from or is tightly closed on the opening 17, it is easier to be turned open or close, by friction force resulting from the projected ridges 142.

Referring to FIG. 1 and FIG. 2 again, in an embodiment of the present invention, the pen 10 can be a three-color pen, wherein the pen 10 is constituted by an upper pen shaft 31 and a lower pen shaft 32. A lower end of the lower pen shaft 32 is provided with a reduced outer diameter to form a pen hole 321 for transfixing a pencil lead 4, and an inner wall at an upper end of the lower pen shaft 32 is formed with a female thread 322. On the other hand, a lower end of the upper pen shaft 31 is fixed with a pencil lead seat 5, and an opening at an upper end of the upper pen shaft 31 is the holding space 12 for installing the storage device 13. The pencil lead seat 5 can hold pencil leads 4 of three different colors, and each pencil lead 4 is sheathed respectively with a spring 41, such that a pen point 42 of the pencil lead 4 which is transfixed out of the pen hole 321 can be provided with elastic force to be retracted into the lower pen shaft 32. An upper end of each pencil lead 4 is provided with a sliding block 43, and an inner wall of the lower pen shaft 32 is provided with a plurality of chutes (not shown in the drawings) which are fitted with the sliding blocks 43, such that when the sliding block 43 slides in the chute, the pen point 42 of the pencil lead 4 can be pushed out of the pen hole 321, or can be retracted into the lower pen shaft 32. On the other hand, an end of the pencil lead seat 5, which is protruded out of the upper pen shaft 31, is provided with a male thread 51 fitted with the female thread 322 of the lower pen shaft 32.

In assembling, an end of the pencil lead seat 5, which is provided with the male thread 51, is inserted into the lower pen shaft 32, along with the pencil lead 4, such that each sliding block 43 is latched into each chute. Then, the upper pen shaft 32 is rotated, such that the male thread 51 of the pencil lead 5 can be screwed with the female thread 322 on the inner wall at the end opening of the lower pen shaft 32, enabling the upper pen shaft 31 to be joined with the lower pen shaft 32, thereby allowing the sliding block 43 to slide in the chute by rotating the lower pen shaft 32, and pushing the pen point 42 of the pencil lead 4, one by one, out of the pen hole 321, or retracting the pencil lead 4 into the lower pen shaft 32, to facilitate writing (or collecting the pen point 42).

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A pen with a storage function comprising a body, an end surface of a penholder of which is concaved with a hollow holding space; a storage device, which is installed in the holding space, an end of which is a circuit board, and an end of which is a USB connector that is electrically connected with the circuit board, wherein the circuit board is located in the holding space, and the USB connector is protruded out of the penholder for connecting with an external computer to download stored data; a protective outer cap which is sheathed on the USB connector to cover and hide the USB connector by being assembled with and separated from the penholder; a light pervious casing which is located at a chosen place on a surface of the penholder of the pen; and at least one solar power flashing LCD, which is surrounded on an inner wall of the penholder, corresponding to the light pervious casing, enabling the LCD to be installed on the inner wall, with a surface of the LCD being provided with commercial prints, such that when the LCD has absorbed sufficient solar energy, the commercial prints are flashingly displayed through the light pervious casing.

2. The pen with a storage function according to claim 1, wherein the USB connector is a male USB connector (plug).

3. The pen with a storage function according to claim 1, wherein the light pervious casing is a transparent casing.

4. The pen with a storage function according to claim 1, wherein an interior of the penholder is installed with the storage device, and an upper and lower inner walls of the penholder are provided respectively with an installation chute, with each of the installation chutes being provided with a left and right clipping pieces in a long-strip shape, for holding two side edges of the storage device and the LCD, such that the storage device and the LCD are inserted into the upper and lower installation chutes from an opening at an upper end of the penholder and are clipped by the left and right clipping pieces, to be positioned on the upper and lower installation chutes, thereby being fixed in the penholder.

5. The pen with a storage function according to claim 4, wherein a center position of the storage device is provided with a round plug having an outer diameter a little smaller than an inner diameter of the holding space of the penholder, such that when the storage device is installed in the upper and lower installation chutes, the round plug is exactly locked at the inner wall of the penholder, thereby enabling the storage device to be firmly fixed at the opening of the end of the penholder.

6. The pen with a storage function according to claim 5, wherein the outer cap is screwed on the opening of the end of the penholder, an inner wall at a connection place of the outer cap is provided with a female thread, and an end surface of the round plug, corresponding to the female thread, is provided with a male thread which is fitted with the female thread, such that the outer cap is screwed on the opening to cover and hide the USB connector, by screwing the female thread with the male thread.

7. The pen with a storage function according to claim 6, wherein an outer surface of the outer cap is surrounded with a plurality of projected ridges, such that when the outer cap is turned open from or tightly closed on the opening, the outer cap is easier turned open or close, by friction force resulting from the projected ridges.

8. The pen with a storage function according to claim 1, wherein the pen is a three-color pen.

* * * * *